US006149262A

United States Patent [19]

Shiida et al.

[11] Patent Number: 6,149,262

[45] Date of Patent: Nov. 21, 2000

[54] INK-JET PRINTER HAVING A HEAD SUPPORTING MEMBER ROTATABLE AROUND A SPINDLE AND HAVING A POSTURE REGULATOR

[75] Inventors: Sakae Shiida, Numazu; Yoshihide Akuzawa; Akira Nuita, both of Shizuoka-ken, all of Japan

[73] Assignee: Toshiba Tec Kabushiki Kaisha, Tokyo, Japan

[21] Appl. No.: 09/083,898

[22] Filed: May 22, 1998

[30] Foreign Application Priority Data

May 26, 1997 [JP] Japan ..... 9-135307

[51] Int. Cl.[7] ..... B41J 23/00

[52] U.S. Cl. ..... 347/37

[58] Field of Search ..... 347/37, 8–9, 20, 347/30, 197; 346/139 R; 400/120.1, 124.12, 175, 701

[56] References Cited

U.S. PATENT DOCUMENTS

| | | | |
|---|---|---|---|
| 4,227,219 | 10/1980 | Takemoto | 358/289 |
| 4,860,032 | 8/1989 | Niemeyer, III | 346/139 R |
| 5,055,861 | 10/1991 | Murayama et al. | 347/37 |
| 5,731,829 | 3/1998 | Saito et al. | 347/104 |
| 5,871,292 | 2/1999 | Johnson et al. | 400/28 |

FOREIGN PATENT DOCUMENTS

| | | | |
|---|---|---|---|
| 0 441 425 | 8/1991 | European Pat. Off. . | |
| 0 764 543 | 3/1997 | European Pat. Off. . | |
| 58-145459 | 8/1983 | Japan | 347/8 |
| 1-11857 | 1/1989 | Japan | 347/8 |
| 2-231147 | 9/1990 | Japan . | |
| 3-182356 | 8/1991 | Japan | 347/8 |
| 2 299 788 | 10/1996 | United Kingdom . | |

OTHER PUBLICATIONS

Patent Abstracts of Japan, vol. 017, No. 286 (M–1422), Jun. 2, 1993 & JP 05–016488 A (NEC Corp.) Jan. 26, 1993—Abstract.

Patent Abstracts of Japan, vol. 018 No. 602 (M–1705), Nov. 16, 1994 & JP 06–227086 A (OKI Electric Ind. Co., Ltd.)—Abstract.

*Primary Examiner*—David F. Yockey
*Assistant Examiner*—Thien Tran
*Attorney, Agent, or Firm*—Frishauf, Holtz, Goodman, Langer & Chick, P.C.

[57] ABSTRACT

An ink jet printer includes a rotary drum having a peripheral surface for holding a paper sheet, a print head for printing an image on the paper sheet held on the peripheral surface by jetting ink to the paper sheet, and an elevator mechanism for setting the print head to a printing position close to the peripheral surfice at a time of printing and to a non-printing position farther from the peripheral surface than the printing position along a normal line of the peripheral surface at a time of maintenance. Particularly, the elevator mechanism includes a pair of guide rails set parallel to the normal line of the peripheral surface, a slider unit rotatably holding the print head and slidably attached to the guide rails, and a driving section for moving the slider unit up and down. The slider unit includes a spindle, a head support member rotatable about the spindle by a rotational force applied due to a weight of the printhead, and a posture regulator for regulating a posture of the print head with respect to the guide rails against the rotational force.

8 Claims, 5 Drawing Sheets

INK-JET PRINTER HAVING A HEAD SUPPORTING MEMBER ROTATABLE AROUND A SPINDLE AND HAVING A POSTURE REGULATOR

BACKGROUND OF THE INVENTION

The present invention relates to an ink-jet printer which performs printing on paper sheets by jetting ink.

In recent years, serial ink-jet printers are widely spreading for personal use. A serial ink-jet printer includes a platen for holding a paper sheet and a print head for jetting ink onto the paper sheet on the platen. The print head prints an image for one row on the paper sheet by jetting ink while moving in a main scanning direction parallel to the axis of the platen. The platen feeds the paper sheet in a sub-scanning direction perpendicular to the main scanning direction each time the image for one row is printed.

The print head has a line of ink-jet nozzles each for jetting ink to form one dot. As the ink-jet nozzles are repeatedly used, they become clogged with dust or ink unnecessarily present in the nozzles. In particular, clogging occurs frequently in a multicolor print head which has a greater number of ink-jet nozzles than a monochrome print head. To prevent clogging, the ink jet nozzles are cleaned by periodical maintenance.

In the maintenance, the print head is moved outside a paper holding region of the platen in the main scanning direction. At this position, the unnecessary ink is discharged from all the ink-jet nozzles, for example, by means of a cleaning unit of the vacuum type. The cleaning unit includes a suction pump for creating negative pressure, and a suction tool which is brought into contact with the ends of the ink-jet nozzles to draw out the unnecessary ink by the negative pressure applied from the suction pump.

Recently, an improved ink-jet printer has been developed, which can perform multicolor-printing at a higher speed than the aforementioned printer. This type of ink-jet printer includes a rotary drum for rotating at a constant circumferential speed and an ink-jet print head for jetting color inks onto a paper sheet held on the peripheral surface of the rotary drum. Printing is performed in a condition where the paper sheet has been supplied to the rotary drum from the front side of the drum, and rolled on the drum. After the printing, the paper sheet is separated from the rotary drum, and discharged the rear side of the drum.

The print head includes nozzle units for the colors of, for example, yellow, cyan, magenta and black, which are arranged along the peripheral surface of the rotary drum. Each nozzle unit has a plurality of ink-jet nozzles lined across the paper sheet in a main scanning direction parallel to the axis of the rotary drum, and performs printing in the overall area of the paper sheet by jetting ink from the ink-jet nozzles while the paper sheet is moved in a sub-scanning direction perpendicular to the main direction in accordance with the rotation of the drum.

However, since the print head of the ink-jet printer is relatively large in size, a large space is required in the housing of the printer to move the print head for the maintenance. This is an obstacle to making a compact ink-jet printer.

Further, when the print head is moved outside the paper holding region of the rotary drum in the main scanning direction, the long distance of the movement not only hinders an increase in maintenance speed but also reduces the accuracy of positioning the print head with respect to a paper sheet, resulting in difficulty in obtaining a high-quality print.

BRIEF SUMMARY OF THE INVENTION

An object of the present invention is to provide an ink-jet printer, the maintenance of which can be performed quickly without contradicting the compactness of the apparatus and the production of a high-quality print.

According to the present invention, there is provided an ink-jet printer which comprises a holding member having a holding surface for holding a print medium, a print head for printing an image on the print medium held on the holding surface by jetting ink to the print medium, and a head moving mechanism for setting the print head to a printing position close to the holding surface at a time of printing and to a non-printing position farther from the holding surface than the printing position along a normal line of the holding surface at a time of maintenance; the head moving mechanism includes a pair of guide members set parallel to the normal line of the holding surface, a slider unit rotatably holding the print head and slidably attached to the guide members, and a slider unit driving section for moving the slider unit up and down; and the slider unit includes a posture regulator for regulating a posture of the print head with respect to the guide members against rotational force due to weight of the print head.

In this ink-jet printer, since the print head is moved along the normal line of the holding surface, the distance of movement of the print head can be reduced as compared to a case the print head is moved parallel to the holding surface to the outside of the medium holding area of the holding surface. Therefore, delay of maintenance due to the movement of the print head can be reduced. In addition, it is unnecessary to provide a space corresponding to the size of the print head outside the medium holding area. Moreover, since the posture regulator regulates the posture of the print head with respect to the guide members, the posture of the print head is kept unchanged at the printing time and the maintenance time. Particularly at the printing time, the operation of the posture regulator makes the ink jetting conditions uniform. Thus, the maintenance can be performed quickly and reliably without an adverse influence on the reduction in size and improvement of the quality of printed images.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An ink-jet printer according to an embodiment of the present invention will be described with reference to the accompanying drawings.

The ink-jet printer is used to print a multicolor image on a paper sheet M cut as a printing medium. The paper sheet M may be a plain paper or OHP sheet.

Figure 1:
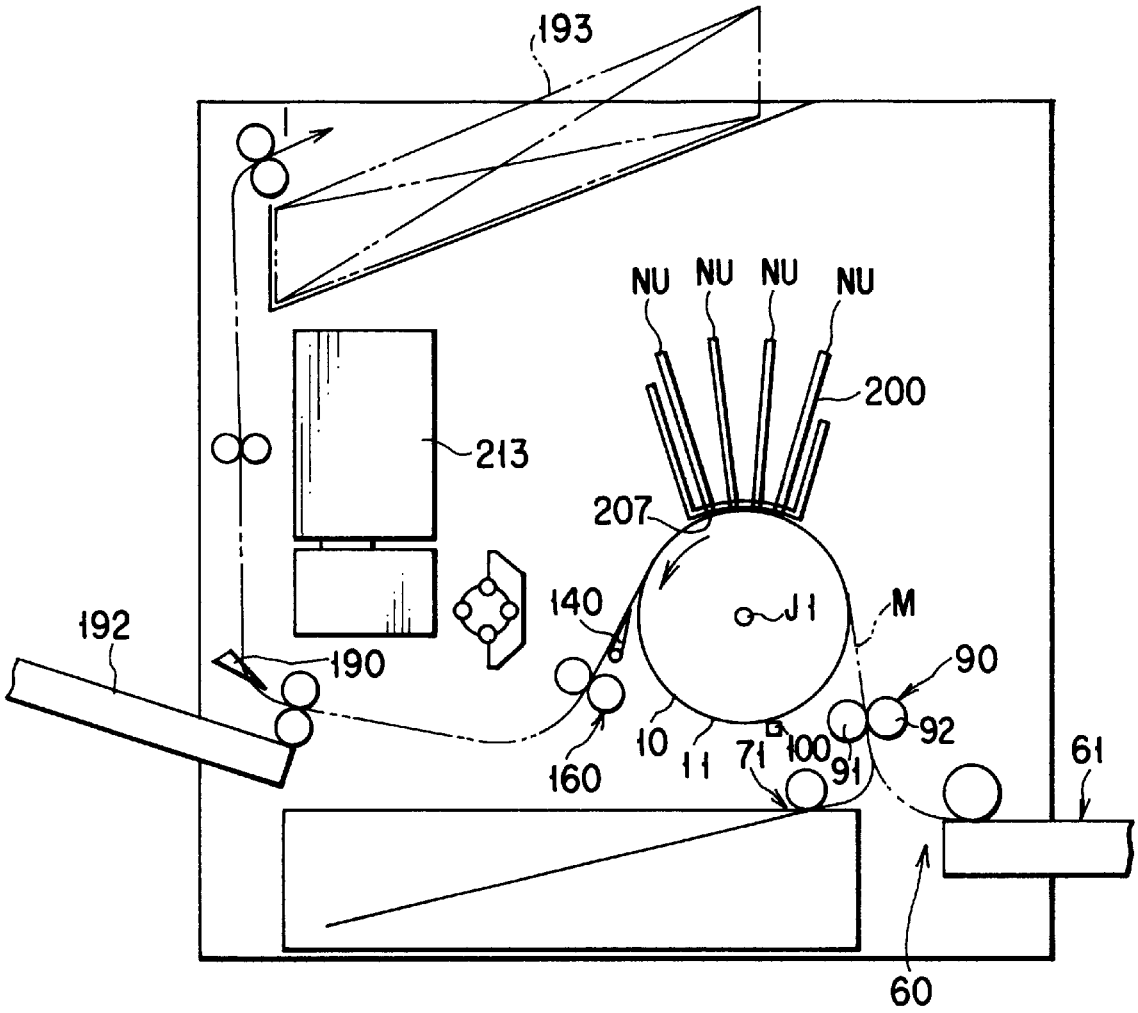
FIG. 1 is a diagram showing an internal structure of an ink-jet printer according to an embodiment of the present invention.

FIG. 1 shows an internal structure of the ink-jet printer. The ink-jet printer includes a rotary drum 10 which holds a paper sheet M and rotates at a constant circumferential speed, and a print head 200 for printing a multicolor image on the paper sheet M rotating along with the rotary drum 10. The ink-jet printer also includes a manual feed tray 61 for receiving a paper sheet M to be inserted one by one, a paper cassette 71 for containing a stack of paper sheets M, a sheet feed-in mechanism 60 for feeding a paper sheet M to the rotary drum 10 from the manual feed tray 61 and paper cassette 71, a sheet feed-out mechanism 160 for feeding out the paper sheet M printed at the rotary drum 10, and a control unit for controlling the overall operation of the ink jet printer. As shown in FIG. 1, the rotary drum 10 is located near the central position within a housing 1. The manual feed tray 61 is located below the rotary drum and projects externally from a front surface of the housing 1, and the paper cassette 71 is located under the rotary drum 10. The sheet feed-in mechanism 60 is placed between the manual feed tray 61 and the paper cassette 71. The print head 200 is located above the rotary drum 10. The sheet feed-out mechanism 160 is located behind the rotary drum 10.

The rotary drum 10 is supported so as to be rotatable about the axis, and holds the paper sheet M wound around a peripheral surface 11 in accordance with its rotation. The rotational position of the rotary drum 10 is detected by a rotational position detector 100 provided near the peripheral surface of the rotary drum 10. The print head 200 includes nozzle units NU which are arranged in series along the peripheral surface 11 of the rotary drum 10 from the upstream side to the down stream side so as to perform printing on the paper sheet M with inks of yellow, cyan, magenta and black. These nozzle units receive inks of the corresponding colors from four ink supplying unit 213 remote therefrom. Each nozzle unit NU has a plurality of ink-jet nozzles 207, arranged at pitch PT of, for example, 1/75 inch in the axial direction of the rotary drum 10, for jetting the corresponding color ink to the paper sheet M. The ink-jet nozzles are arranged to have a span correspond to 210 mm, i.e., the width of the paper sheet M of A4 size. The sheet feed-in mechanism 60 includes a paper loader 90 for loading the paper sheet M to the rotary drum 10 such that the width direction of the paper sheet M coincides with the axial direction of the rotary drum 10, and feeds the paper sheet M taken out of either the manual paper or the paper cassette 71. The paper loader 90 is controlled to feed the paper sheet M toward the rotary drum 10 when the position detector 100 detects that the rotary drum 10 has arrived at a predetermined rotational position. The print head 200 prints a multicolor image on the paper sheet M as the rotary drum 10 rotates.

The paper sheet M is separated from the peripheral surface 11 of the rotary drum 10 by a paper separation unit 140 and fed in a predetermined direction by the sheet feed-out mechanism 160. The paper separation unit 140 is a separation claw which is brought into contact with the rotary drum 10 at the time of separating the paper sheet. A discharge switch 190 guides the paper sheet M to a selected one of a rear discharge tray 192 with the print surface facing upward, and an upper discharge tray 193 with the print surface facing downward.

The print head 200 can be slightly and reciprocally shifted in a main scanning direction X parallel to the axis of the rotary drum 10. The rotary drum 10 holds the paper sheet M wound around and held on the peripheral surface 11, and rotates to move the paper sheet M in a sub-scanning direction Y perpendicular to the main scanning direction X, with the paper sheet M opposing to the nozzle units NU. To achieve a multicolor print of, for example, 20 PPM, the rotary drum 10 is maintained to be a constant rotation rate of 120 rpm; that is, it is rotated at one revolution per 0.5 second. In a print operation, the nozzle units NU is shifted in the main scanning direction X at a constant rate of ¼ nozzle pitch PT every time the rotary drum makes one revolution, so that it moves by a distance equal to the nozzle pitch PT during four revolutions. With this-structure, the printing of the entire surface of the paper sheet M is completed in 2 seconds (=0.5 second×4) required to make four revolutions of the rotary drum 10. Even taking into consideration a time required to make one revolution of the rotary drum 10 for winding the paper sheet M around the drum before printing and one revolution of the rotary drum 10 for separating the paper sheet after printing, a multicolor image can be printed on the paper sheet M of A4 size at a high speed of 3 (=2+1) seconds per sheet. Thus, printing can be consecutively performed on 20 paper sheets every minute.

The paper loader 90 includes at least a pair of feed rollers 91 and 92 extending in the axial direction of the drum 10 so as to load the paper sheet M supplied from the feeder 61 or 71 to the rotary drum 10 at a predetermined timing. The feed rate of the paper sheet M is set to the circumferential speed of the rotary drum 10. Since the diameter of the rotary drum 10 is 130 mm, a circumferential speed of 816 mm/sec can be obtained. The peripheral surface 11 of the rotary drum 10 is about 220 mm wide in the axial direction and 408 mm long in the rotational direction. Therefore, the rotary drum 10 can fully hold the A4 size paper sheet M having a length of 297 mm and a width of 210 mm.

The ink-jet printer further includes a cleaning unit 230 for the print head 200 and an elevator mechanism 300. The elevator mechanism 300 sets the print head 200 at the time of printing to a printing position P1 close to the peripheral surface 11 at the time of printing, and at the time of maintenance to a non-printing position P2 farther from the peripheral surface 11 than the printing position P1 along a normal line of the peripheral surface 11. The cleaning unit 230 cleans the ink-jet nozzles of the nozzle units NU in a state where the print head 200 is set to the non-printing position P2.

In the ink-jet printer described above, as shown in FIGS. 1 and 2, the print surface M1 of the paper sheet M is held on the peripheral surface 11 of the rotary drum 10 which rotates in a Y direction about a rotation axis J1, so that it can be moved in the Y direction of rotation of the drum 10. A perpendicular axis J2 is a normal line of the drum 10 extending through the rotation axis J1. The ink-jet nozzles 207 of the nozzle units NU for the four colors extend along radial axes originating from the common central point and ink-jetting openings of the respective nozzles are arranged on an arc corresponding to the print surface M1. The elevator mechanism 300 includes a pair of guide rails 301 fixed in parallel with the perpendicular axis J2 at one side of the axis J2 in the rotational direction of the drum 10, a slider 311 attached to the guide rails 301 so as to be slidable upward and downward, and a slider driving section 321 for driving the slider 311 upward and downward by means of electric power.

Figure 3:
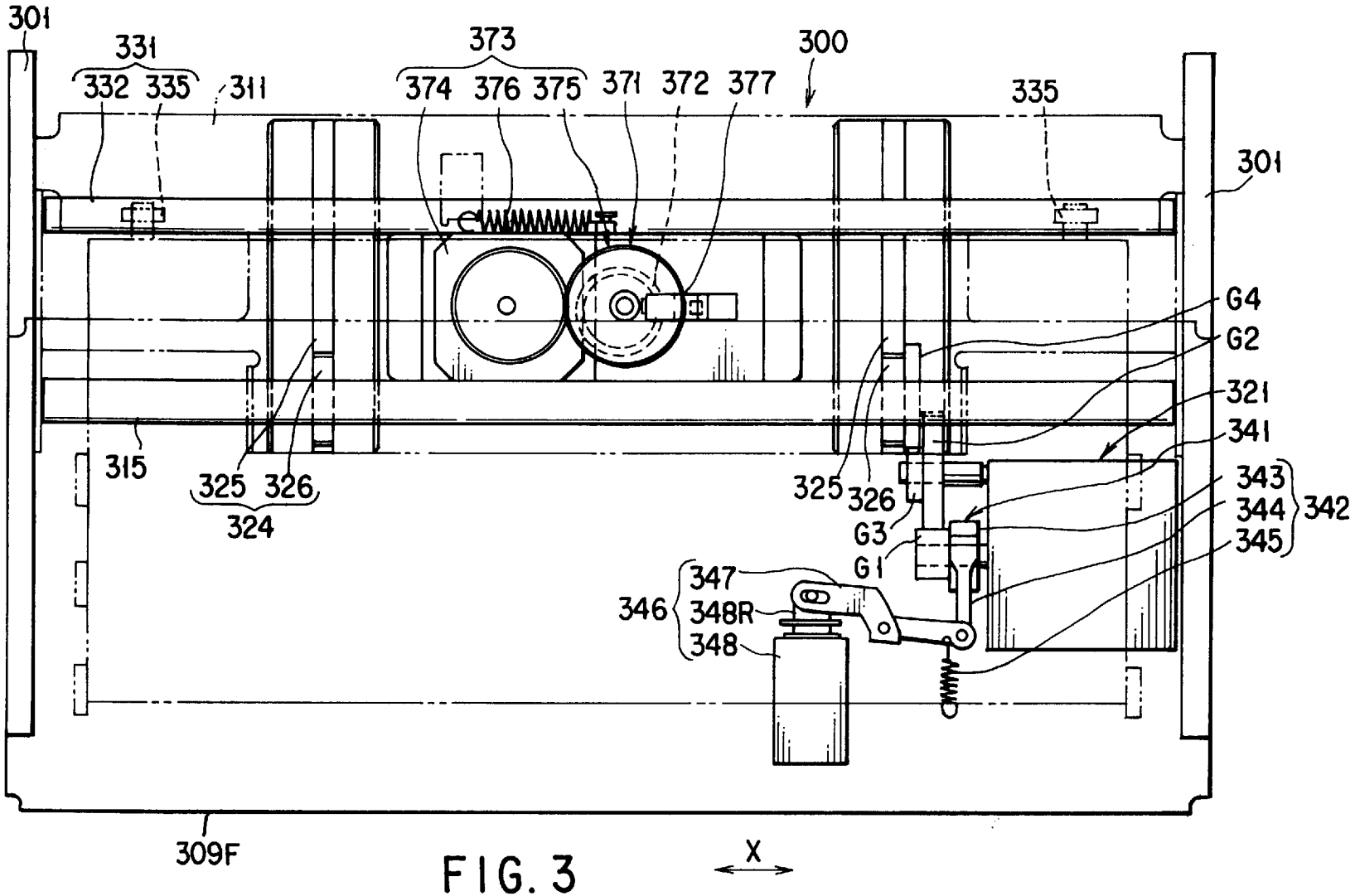
FIG. 3 is a diagram for explaining the elevator mechanism shown in FIG. 2.

More specifically, the guide rails 301 are fixed on both sides of the slider 311 in the main scanning direction X, as shown in FIG. 3. The slider 311 includes a fixed frame 309F mounted between the guide rails 301 and slidable upward and downward with respect to the guide rails 301, a spindle 315 set in parallel with the rotation axis J1 of the rotary drum 10 between the guide rails 301, and a head support member 309 for supporting the print head 200 and rotatable about the spindle 315. The print head 200 is set to a posture regulated by a posture regulating section 331 via the head support member 309.

The posture regulating section 331 is engaged with the slider 311 and regulates the posture of the print head 200 with respect to the guide rails 301 against the rotation force due to the weight of the print head 200 itself. More specifically, the posture regulating section 331 includes a shaft member 332 attached to a portion of the slider 311 above and in parallel with the spindle 315, and a roller 335 rotatably supported on an upper portion of the nozzle support member 309 and pressed against the shaft member 332. The roller 335 is pressed against the shaft member 332 by the rotation force due to the weight of the print head 200.

The print head 200 is reciprocated together with the head support member 309 in the main scanning direction X by means of a reciprocating section 371, thereby printing an image for one row. The reciprocating section 371 includes a cam 372 rotatably supported by the slider 311, a cam driving section 373 for driving the cam 372, and a cam follower 377 attached to the support member 309. The cam driving section 373 includes a driving motor 374, a gear power transmitting mechanism 375 and an engaging spring 376.

The slider driving section 321 includes a motor 322 and a power converting section 323 for converting the rotational power of the motor 322 to elevating force of the slider 311. The power converting section 323 has a rack pinion mechanism 324 and a power transmitting mechanism 327. The rack pinion mechanism 324 is constituted by a rack 325 attached to the slider 311 and extending in the vertical direction and a pinion 326 rotatably supported by the fixed frame 309F and engaged with the rack 325. The power transmitting mechanism 327 has a plurality of gears G1, G2, G3 and G4 for coupling the motor 322 and the pinion 326, so that the rotational power of the motor 322 can be transmitted to the pinion 326. Thus, when the motor 322 is driven, the slider 311 is moved up and down along the perpendicular axis J2.

In the elevator mechanism 300, a brake system 341 is provided in addition to the slider driving section 321, so as to prevent the slider 311 from freely dropping when the slider driving section 321 is unable to drive the slider 311 up and down due to failure of the electric power supply. The brake system 341 has a braking force applying section 342 for applying braking force in association with the motor 322 and the power converting section 323, and an electric control section 346 for performing a control of disabling the braking force applying section 342 when the electric power is normally supplied and enabling the braking force applying section 342 when the power supply is cut.

The braking force applying section 342 has a friction wheel 343, a friction belt 344 and an urging spring 345, so that braking force can be applied to the motor 322 by utilizing the friction force. The friction wheel 343, around which the friction belt 344 is wound, is attached to the rotary shaft of the motor 322. The upper end of the friction belt 344 is connected to the fixed frame 309F and the lower end of the friction belt 344 is connected to the urging spring 345 which pulls the friction belt 344 downward. The friction belt 344 is tightly bound around the peripheral surface of the friction wheel 343 with tension applied from the urging spring 345. As a result, great friction force is generated between the friction belt 344 and the friction wheel 343, and acts on the motor 322 as braking force.

The control section 346 is constituted by a switch lever 347 and a solenoid 348. The switch lever 347 is rotatably attached to the fixed frame 309F via a hinge section. The lower end of the friction belt 344 is connected to one end of the switch lever 347, and a rod 348R of the solenoid 348 is connected to the other end of the switch lever 347. The rod 348R is moved down against the urging force of the urging spring 345 when the solenoid 348 is driven.

The solenoid 348 is driven to loose the friction belt 344 via the switch lever 347 when electric power is supplied to the ink-jet printer. In this state, since there is no friction force between the friction belt 344 and the friction wheel 343, braking force is not supplied to the motor 322. When the power supply is cut, the solenoid is not driven and the friction belt 344 is tightly bound around the friction wheel 343 due to the urging force of the urging spring 345, thereby applying braking force to the motor 322.

The cleaning unit 230 includes a suction tool 231, an elastic wiper 234 provided on the top surface of the suction tool 231, and a suction tool moving section 235 for moving the suction tool 231 in the main scanning direction X, so as to clean the print head 200 by suctioning ink from the ink-jet nozzles 207 of the nozzle units NU of the four colors, while moving in the main scanning direction X at the non-printing time.

The suction tool 231 is formed of a main body 231D, and a ink-suctioning nozzles 231N arranged radially to face the corresponding nozzle units NU of the four colors. Each ink-suctioning nozzle 231N is connected to a negative pressure creating unit 233 through a pipe 232. The negative pressure creating unit 233 has a waste ink storage tank 233T and a suction pump 233P. The suction pump 233P is driven in a state where the ink-suctioning nozzles 231N are aligned with the ends of the corresponding ink-jet nozzles 207, so as to collect ink present in the ink-jet nozzles 207 into the waste ink storage tank 233T. Immediately after the cleaning, the wiper 234 is brought into contact with the front ends of the ink-jet nozzles 207 and wipes off the ink present thereon.

Figure 2:
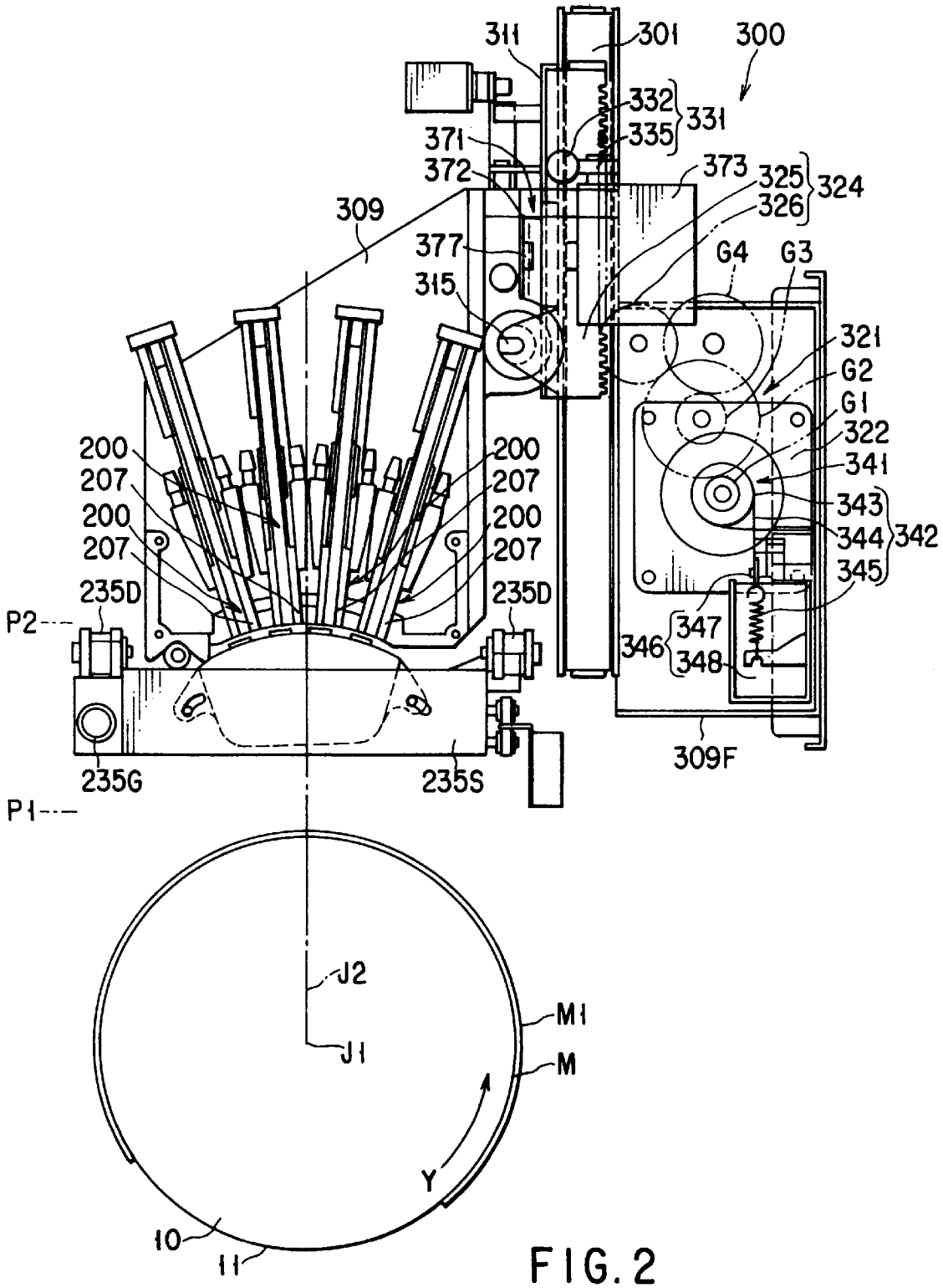
FIG. 2 is a diagram showing a peripheral structure of the print head shown in FIG. 1.
Figure 4:
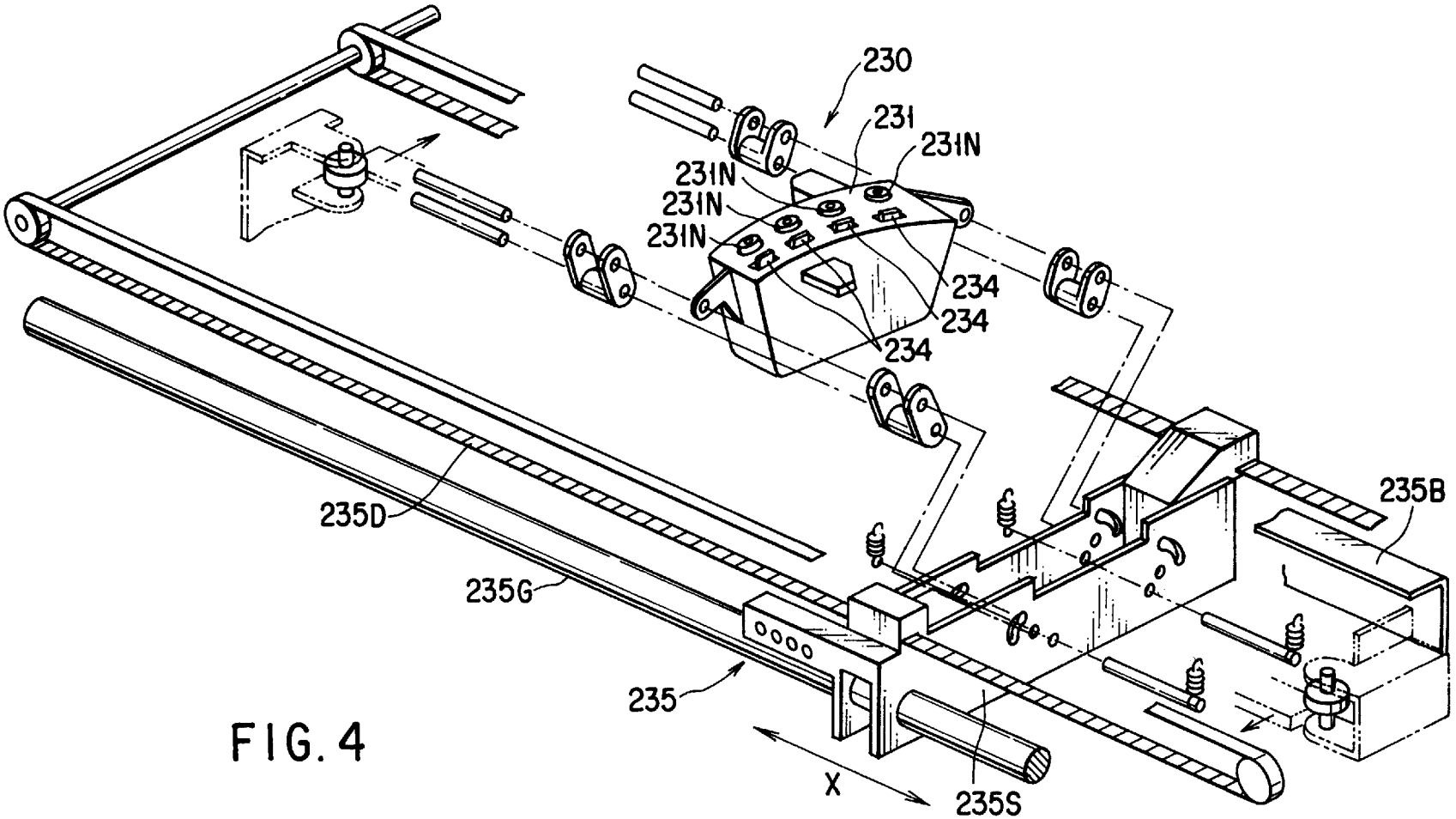
FIG. 4 is a diagram showing the cleaning unit of the ink-jet printer shown in FIG. 1.
Figure 5:
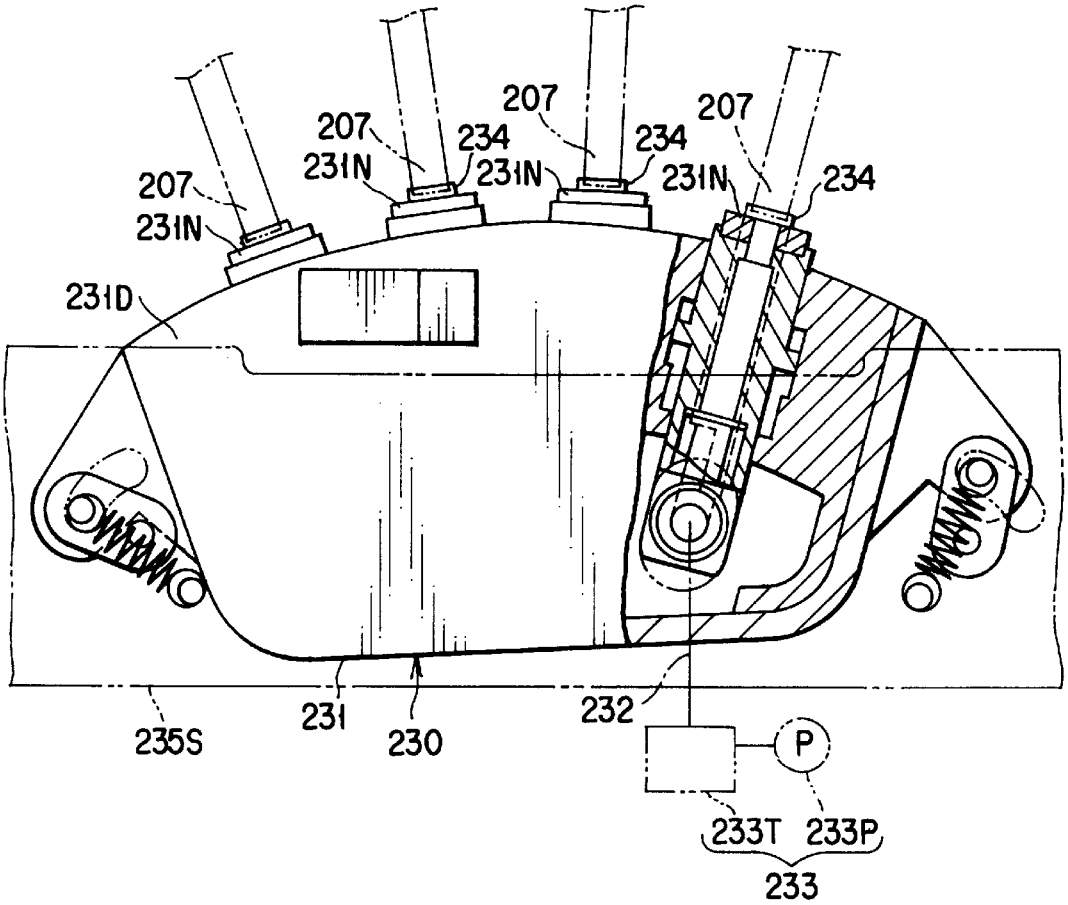
FIG. 5 is a diagram for explaining the positional relationship between the cleaning unit and each ink-jet nozzle.

As shown in FIGS. 2 and 4, the suction tool moving section 235 includes a guide section, a suction tool support member 235S and a belt transmission mechanism 235D. The guide section is formed of a guide rod 235G and a guide bar 235B which are parallel to the rotation axis J1 of the drum 10. The suction tool support member 235S is slidably supported by the guide rod 235G and the guide bar 2235B. The belt transmission mechanism 235D is arranged to move the suction tool support member 235S along the guide rod 235G and the guide bar 235B. The suction tool 231 is attached to the suction tool support member 235S such that the ink-suctioning nozzles 231N can face the ends of the corresponding ink-jet nozzles 207 without any contact. In other words, the positional relationship between the ink-suctioning nozzles 231N and the corresponding ink-jet nozzles 207 is adjusted so as to form a small gap therebetween.

A maintenance operation of the ink-jet printer will now be described. The maintenance operation is performed at the non-printing time. In the maintenance operation, the motor 322 of the slider driving section 321 is driven to move up the slider 311. As a result, the print head 200 is moved from the printing position P1 to the non-printing position P2. After the movement of the print head 200, suctioning of ink is performed by the suctioning nozzles 231N while the suction tool support member 235S is moved forward in the main scanning direction X by the driving of the suction tool moving section 235. More specifically, as the suction tool support member 235S is moved forward, the suctioning nozzles 231N are aligned with the corresponding ink-jet nozzles 207 and suction the ink from the nozzles 207 by negative pressure. Therefore, ink can be drawn reliably with a relatively small suction force of negative pressure. With this cleaning, the possibility of the ink-jet nozzles being clogged with the unnecessary ink is satisfactorily reduced. In addition, the ink remaining on the nozzles after the cleaning is wiped off by the elastic wiper 234 of the cleaning unit 230, which is brought into contact with the ink-jet nozzles 207. Therefore, ink is prevented from hardening at the end portions of the nozzles 207. Consequently, all the nozzles 207 are cleaned uniformly without failure by a relatively small suction force of negative pressure.

In the ink-jet printer of the above embodiment, the print head 200 is movable from the printing position P1 to the non-printing position P2 along the perpendicular axis J2 to perform the maintenance operation. With this structure, it is unnecessary to prepare a large space in the main scanning direction X for the maintenance. Further, the direction of the perpendicular axis J2 differs from the main scanning direction X in which the print head 200 is moved at the printing time, i.e., the direction of the rotation axis J1 of the rotary drum 10. Therefore, the positional relationship between the ink-jet nozzles 207 and the print surface M1 is prevented from being changed when the print head 200 is returned to the print position P1. Thus, it is possible to provide a compact ink-jet printer, which can prevent the print quality from lowering and the maintenance time from increasing.

The elevator mechanism 300 uses electric power to drive the slider 311 which supports the print head 200 and is slidable up and down along the guide rails 301. For this reason, the position of the slider 311 can be quickly switched to set the print head to the printing position P1 or the non-printing position P2 without impairing the accuracy. Moreover, the elevator mechanism 300 has the brake system 341 for preventing the slider 311 from freely dropping when supply of electric power is cut. This protects the ink-jet nozzles 207 from breakage caused by excessive shock applied when the slider 311 drops. Thus, the printing speed, the printing quality and the endurance of the printer can be further improved. In addition, the slider driving section 321 uses the ordinary motor 322 to generate a driving force from electric power, and the control section 346 refers to supply of the electric power in the control of the braking force applying section 342. Therefore, the structure are much more simplified and the applicability is expanded as compared to the conventional art.

The posture regulating section 331 causes the posture of the print head 200 to be unchanged with respect to the guide rails 301 in both the printing and maintenance operations. With this feature, uniform ink-jetting conditions can be obtained in every printing operation. Thus, the maintenance can be performed quickly and reliably without contradicting the reduction in size and improvement of the printing quality.

Furthermore, the head support member 309 is rotatable about the spindle 315 along with the print head 200 and brought into contact with the shaft member 332 attached to the slider 311, thereby regulating the posture of the print head 200. Thus, the number of components requiring high accuracy in manufacture can be reduced as compared to a structure in which the head supporting member 309 is fixed. In this embodiment, only the shaft member 332 and the roller 335 requires high accuracy in manufacture to regulate the posture of the print head 200. If the head support member 309 is fixed, a plurality of guide rails are required to move the print head 200 in the main scanning direction X. Therefore, it is necessary to precisely set the positional relationship between the guide rails. However, this problem does not arise in the structure of this embodiment, in which the head support member 309 is rotatably supported about the spindle 315 and brought into contact with the shaft member 332 by the weight of the print head 200. This structure makes assembling and disassembling of the printer easier and allows the posture of the print head 200 to be constant without using a spring or the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

What is claimed is:

1. An ink-jet printer comprising:

a holding member having a holding surface for holding a print medium;

a print head for printing an image on the print medium held on said holding surface by jetting ink from an end thereof to the print medium; and a head moving mechanism for setting said print head to a printing position close to said holding surface at a time of printing and to a non-printing position farther from said holding surface than the printing position at a time of maintenance;

wherein said head moving mechanism includes a pair of guide members disposed vertically with respect to said holding surface, a slider unit rotatably holding said print head and slidably attached to said guide members, and a slider unit driving section for moving said slider unit up and down; and wherein said slider unit includes a spindle extending horizontally between said guide members, a head support member supporting said print head and rotatable about said spindle by a rotational force applied due to a weight of said print head, and a posture regulator for regulating a posture of said print head against the rotational force such that the end of said print head faces said holding surface.

2. The ink-jet printer according to claim 1, wherein:

said slider unit is located above said holding member;

said slider unit driving section comprises an electric power supply; and said head moving mechanism further includes a brake system for preventing said slider unit from freely dropping when said slider unit driving section is unable to drive said slider unit due to a failure of the electric power supply.

3. The ink-jet printer according to claim 2, wherein:

said slider unit driving section includes a motor and a power converting section which converts a rotational force of said motor to an elevating force for said slider unit; and said brake system includes a braking force applying section which generates a braking force in association with said motor and said power converting section, and an electrical control section which disables said braking force applying section when electric power is normally supplied from the electric power supply and which enables said braking force applying section when electric power from the electric power supply is cut.

4. The ink-jet printer according to claim 1, wherein:

said holding member comprises a rotary drum rotatable in one direction along with the print medium and having a peripheral surface around which the print medium is wound; and said posture regulator includes a pressed member located above said spindle and a pressing member pressed against said pressed member by the rotational force due to the weight of said print head.

5. The ink-jet printer according to claim 4, wherein:

said pressed member comprises a shaft member set parallel to an axial direction of said rotary drum;

said pressing member is a roller rotatable in a state where it is pressed against said shaft member by the rotational force due to the weight of said print head; and said ink-jet printer further comprises a reciprocating section which reciprocates said print head in a direction parallel to the axial direction of said rotary drum along with said head support member at the time of printing.

6. The ink-jet printer according to claim 4, further comprising a cleaning section which suctions ink present in said print head when said print head is set in the non-printing position.

7. The ink-jet printer according to claim 6, wherein:

said print head includes a plurality of ink-jet nozzles arranged in an axial direction of said rotary drum; and said cleaning section includes a suction tool for suctioning ink present in said ink-jet nozzles of said print head and a suction tool moving section for moving said suction tool in the axial direction of said rotary drum.

8. The ink-jet printer according to claim 7, wherein said cleaning section further includes an elastic wiper which is brought into contact with front ends of said ink-jet nozzles after cleaning by said suction tool and which wipes off ink present on said front ends.

* * * * *